US006202904B1

(12) United States Patent
Casciano

(10) Patent No.: US 6,202,904 B1
(45) Date of Patent: Mar. 20, 2001

(54) DRY BREAKFAST FOOD PORTABLE STORING AND DIRECT MOUTH FEEDING CONTAINER APPARATUS

(76) Inventor: Frederick M. Casciano, P.O. Box 88121, Honolulu, HI (US) 90830

( * ) Notice: Subject to any disclaimer, the term of this patent is extended or adjusted under 35 U.S.C. 154(b) by 0 days.

(21) Appl. No.: 09/144,496

(22) Filed: Aug. 31, 1998

Related U.S. Application Data

(63) Continuation-in-part of application No. 08/085,912, filed on Jul. 6, 1993.

(51) Int. Cl.[7] ..... B65D 25/48
(52) U.S. Cl. ..... 222/567
(58) Field of Search ..... 222/567, 568, 222/570, 566, 575; D9/435

(56) References Cited

U.S. PATENT DOCUMENTS

| | | |
|---|---|---|
| 1,983,101 | 12/1934 | Scribner . |
| 2,309,385 | 1/1943 | Fleming . |
| 2,804,988 | 9/1957 | Dobbins III . |
| 3,341,089 | 9/1967 | Pearsall . |
| 3,750,722 | 8/1973 | Nowak . |
| 4,068,778 | 1/1978 | Wilson . |
| 4,129,236 | 12/1978 | Wrycraft et al. . |
| 4,146,157 | 3/1979 | Dixon, Sr. et al. . |
| 4,452,381 | 6/1984 | Freeman . |
| 4,572,386 | 2/1986 | Marcus . |
| 4,640,855 | 2/1987 | St. Clair . |
| 4,653,676 | 3/1987 | Stull . |
| 4,883,192 | 11/1989 | Krugman . |
| 4,925,051 | 5/1990 | Herbst . |
| 5,065,909 | 11/1991 | Pino et al. . |

FOREIGN PATENT DOCUMENTS

| | | |
|---|---|---|
| 767270 | 7/1934 | (FR) . |
| 1032327 | 7/1953 | (FR) . |
| 808 | 1/1895 | (GB) . |

OTHER PUBLICATIONS

Catalog publication of relevant pages from 1988 and 1994 issues showing a "Quick Shake Container" for liquids.

*Primary Examiner*—Henry J. Recla
*Assistant Examiner*—Peter deVore
(74) *Attorney, Agent, or Firm*—James Creighton Wray; Meera P. Narasimhan

(57) ABSTRACT

A dry breakfast food portable storing and direct mouth feeding container apparatus has a detachable cap and integral pour spout for the easy dispensing of dry particulate food matter directly into a mouth of a user. The cap/spout has a dome-shaped, conical or pyramid-shaped surface extending from a large opening at one end which mates to the container to a smaller opening at the other end, which serves as a mouthpiece. The large opening has a threaded or snap-on/press-on type fitting for mating to a complementary opening of a food container. The smaller opening is equipped with a threaded or snap-on/press-on closure cap.

23 Claims, 2 Drawing Sheets

DRY BREAKFAST FOOD PORTABLE STORING AND DIRECT MOUTH FEEDING CONTAINER APPARATUS

CROSS-REFERENCE TO RELATED APPLICATIONS

This application is a continuation-in-part of U.S. patent application Ser. No. 08/085,912 filed Jul. 6, 1993. This earlier application and its listed references are incorporated herein by reference.

FIELD OF THE INVENTION

The present invention relates generally to containers. More particularly, the invention relates to a dry breakfast food portable storing and direct mouth feeding container apparatus.

BACKGROUND

When in search of a healthy, nutritious dry snack food one has a difficult time locating such a product on the supermarket snack food shelves which are replete with fat and salt laden snacks such as potato chips, corn chips, corn puffs, pretzels, etc. However, one glance at the cereal shelves reveals a host of healthy vitamin, mineral and fiber filled products in the form of flakes, grains, oats, puffed rice, etc. The only problem is that these nutritious products are intended for use as a breakfast food and may only be effectively consumed with a spoon after being placed in a bowl with milk added. Trying to ingest these cereals away from the breakfast table, in dry form, from a cup or glass or from one's hand is difficult and frustrating as much of the product is spilled onto your shirt and the floor. Thus, aside from incorporating these cereals into cookies, snack cakes or puddings, one must be resigned to obtaining his daily fiber requirement at breakfast and mixed with milk which for some, such as dairy-product-free vegetarians, is not practical.

This dilemma can be overcome through the use of a container specifically designed to conveniently store, transport and dispense such cereal products directly into a person's mouth. Unfortunately, at this time, no such container exists on the market. There are a multitude of jars, cups, pitchers and containers available for the storage and dispensing of water or liquid drinks either directly into the mouth or into other dispensers. The military canteen is probably the best known of the direct drinking containers and is the forerunner to several plastic containers presently available that serve a similar function. There are also large plastic containers on the market designed to store and dispense dry food products into bowls or other containers but definitely not directly into one's mouth. Thus, the invented container apparatus will provide a product and service which is currently unavailable, and one which will prove to have significant value to the presently nutrition conscious public.

SUMMARY OF THE INVENTION

The invented container apparatus is a plastic container designed to efficiently receive, store, and transport dry food and to dispense it directly into a person's mouth for ingestion. The primary food types intended to be carried in the container would be those classified as breakfast cereals including various flakes, grains, oats (granola), puffed rice, muesli, etc. However, it is expected that other nutritious dry foods such as raisins, nuts, chopped dates and prunes, banana chips and those categorized as "trail mix" would be included to sweeten the mixture resulting in a more appetizing snack food.

This invention has the following primary characteristics which makes it unique and capable of carrying out its objectives. It essentially consists of two components:

(1) A cup or container capable of holding anywhere from ten (10) to fifty (50) fluid ounces of food when full, however an ideal capacity is about twenty (20) fluid ounces. It is extremely important that this container have sufficient diameter (if circular) or width (if rectangular) to permit it to have an opening on top, called the fill opening, which is large enough to conveniently allow cereal to be transferred into it without spillage from a cereal carton or other large container in which a custom mix was prepared. The minimum size of this opening is deemed to be seventy (70) millimeters. Since the container apparatus is a hand held dispenser the maximum diameter (or width) of this container is essentially limited by the grip capability of the human hand which is deemed to be about one hundred and twenty (120) millimeters maximum with the optimum, most comfortable size, at about eighty-five (85) millimeters. However, this maximum dimension could be increased if a handle were attached to the container directly. In such a case the maximum dimension would be limited only by the practical considerations related to packing and carrying this device in a back-pack, on a bicycle, boat or car as a personal snack dispenser. A diameter, or width, greater than one hundred and sixty (160) millimeters would be unwieldy.

(2) A cap or lid for the container which also functions as a spout to direct and dispense the snack food directly into the user's mouth. This cap is attached to the container by a threaded or snap-on fitting. This cap/spout has two critical qualities: it has a funnel or dome shape, and it has a capped second opening, called the pour opening or mouthpiece, which is designed and sized to insure that the food enters the person's mouth without spillage. The funnel or dome-shaped spout has three functions:

(a) It serves to insure that an air void exists in the volume enclosed by the container and spout combined once the container has been filled to the rim with food product. Such a void is critical to the effective dispensing of the granular cereal and flakes through the mouthpiece. The open space allows a free surface condition to be maintained when the container is tilted to allow gravity forces to direct the grains down and out through the opening. The free surface permits the food particles to slide and tumble individually and collectively down the slope. Whereas, without a void and free surface effect, particles of a size which would otherwise individually pass through the opening, tend to wedge together and create a "log jam" effect at the opening. This problem does not enter into the design of liquid dispensers.

(b) It prevents the user's nose from striking the cap during use. In order to initiate the flow of dry food particles, the container must be tilted at an angle sufficient to overcome the stability, or equilibrium, of the product. This angle from the horizontal that must be exceeded, called the angle of repose, depends upon the nature of the particles. For the food products in question this angle can easily be forty-five (45) degrees or more. For liquid products this angle is essentially zero. Thus the tilt angle required to dispense the dry product into one's mouth must generally exceed forty-five (45) degrees. With a flat container cap having a diameter exceeding seventy (70) millimeters and with the pour opening in one s mouth, one cannot tip the container even into a horizontal alignment without striking his nose on the cap. Thus, to compensate for this restriction, one must tilt his head back to uncomfortable positions to create an angle which exceeds the angle of repose. This problem is overcome by using a funnel or conical-shaped spout with a considerable taper.

(c) A tapered, funnel-type spout directs the flow of granular food product smoothly down the walls to the mouthpiece as opposed to a flat cap which is less effective in channeling the flow out the mouthpiece.

The spout can either be in the form of a funnel with constant sloped sides or dome-shaped with curved sides proceeding upward from the base. The funnel-shaped spout can either be of conical or pyramid form. The preferred shape to minimize nose interference is conical or pyramid and with a side slope of thirty (30) degrees or larger measured from the horizontal plane. The larger the slope of the spout the more effective it becomes with regard to this problem, toward providing the maximum void space per unit cup diameter, and toward decreasing the tilt angle required to dispense the food product when the container is approaching empty. However, the optimum angle for a uniformly tapered spout is deemed to be about sixty (60) degrees as the log jam effect can be exacerbated with very steep funnel angles. The spout should produce a void space equal to at least fifteen (15) per cent or more of the volume of food product in a full container, yet a larger void is more effective in promoting free flow.

In an alternative embodiment, the shape for the spout consists of an asymmetrical, or non-uniform tapered, cone such that a wall of the pour opening is aligned vertically above the wall of the container. The function of this asymmetrical taper is to produce the greatest free surface effect possible for the void space available when the container is full. This results when the spout is oriented such that the mouthpiece is in the uppermost position when tipping the container to ingest the contents. As the container is emptied, the unit is rotated to place the mouthpiece at its lowest position to be able to facilitate dispensing the remaining food with a minimum tilt angle.

The pour opening, or mouthpiece, has certain essential qualities to cause it to be effective for dispensing solid particulate food, versus liquids, into the user's mouth. It must have internal dimensions which are sufficient to permit the passage of typical food particles through the opening, yet the outside dimensions must be small enough to be compatible with the size of a person's mouth. Also, it is helpful if it projects somewhat from the walls of the spout to insure that at least the lower perimeter of this protruding lip can be inserted into one's mouth to act as a trough, or chute, for the food. The length of this projection is limited by considerations of log jam potential. From this standpoint, the shorter the better. Also, it should be short enough that one's tongue can be used to clear log jams at the transition from the spout walls to the mouthpiece. The maximum length of this projection would be thirty (30) millimeters with the optimum seen to be about twelve (12) millimeters. The intersection of the spout walls with the mouthpiece must be rounded and fair to insure the smooth flow of food particles. The mouthpiece can be of a circular or oval shape, but no axial internal dimension should be less than twenty-six (26) millimeters, with the optimum diameter deemed to be thirty-six (36) millimeters for a circular opening, with no internal restrictions. Optimum axial inside dimensions for an oval shape are thirty-three (33) and thirty-eight (38) millimeters, respectively. The maximum outside dimension should not exceed fifty (50) millimeters and the optimum would be about thirty-eight (38) millimeters for a circular opening.

A preferred mouthpiece would possess a beveled or angled entrance in order to minimize the angle of head tilt required of the user to ingest the food. A thirty (30) degree taper on the mouthpiece would reduce the head tilt required, and inconvenience, by an equivalent amount. A further improvement would see the profile of the beveled mouthpiece shaped to conform to the contours of an open mouth for comfort and to insure a minimum of spillage. The mouthpiece must be capped with a threaded (for a circular, non-beveled orifice) or interference fit (snap-on) cap. It is preferable that a retaining strap, or tether or hinge, be included which attaches the cap to the spout to prevent loss. This strap should be flexible enough such that the cap when removed does not strike the user's face when ingesting the contents.

In a preferred embodiment, the dry breakfast food portable storing and direct mouth feeding container apparatus includes a wide containment body a direct mouth-feeding cap. The containment body has a base, sidewalls extending upwardly from the base and an open top. A first connector is positioned on the sidewalls near the top of the container.

The direct mouth-feeding cap includes a sidewall rim and a non-axial funnel shaped sloping wall. A second connector is positioned on the sidewall rim and cooperates with the first connector in holding the cap assembled on the container body. The non-axial funnel shaped sloping wall has a large end connected to the rim and a small end opposite the large end. A mouthpiece is connected to the small end of the wall. The mouthpiece has a broad lower lip for overlying a lower lip of a user and extending into a user's mouth beyond a user's teeth and has broad side lips connected to the lower lip and sloping therefrom toward the large end and a narrow top lip for engaging fitting within an upper lip of a user. The top lip is connected to the side lips and is displaced from the broad lower lip toward the large end for allowing the assembled cap and container to be substantially tipped with respect to a user's mouth beyond an angle of repose of a dry breakfast food product. In addition, the mouthpiece is sufficiently short so that a user's tongue can be extended through the mouthpiece to break dry breakfast food jams at an intersection of the mouthpiece and the sloping wall. A releaseable closure is connected to the mouthpiece and a flexible tether is connected to both the closure and the cap.

In another preferred embodiment, the dry breakfast food portable storing and direct mouth-feeding container apparatus includes a substantially hollow container and a substantially hollow offset frustoconical-shaped spout. The container has an end wall, a continuous sidewall extending upwardly from the end wall and a generally open end opposite the end wall. The substantially hollow offset frustoconical-shaped spout has a continuous sidewall extending between an open base and a top part cut off by a plane that is not parallel to the base thereby forming an opening. The base is demountably attachable to the open end of the dry food storage container. As previously discussed, the sidewall of the spout has a first connector located proximate to the base and the sidewall of the container has a second connector located proximate to the open end which cooperates with the first connector in holding the spout assembled on the container.

The invented container apparatus also includes a substantially hollow integrally formed mouthpiece that extends upwardly from the sidewall of the spout thereby circumscribing the opening and a cap that is removably securable in the mouthpiece for closing the opening. Preferably, a tether is integrally formed with and extending from said cap and pivotally attached to said sidewall of said of said spout. The mouthpiece has an open bottom end located proximate to the top part of the spout, a cylindrically-shaped sidewall extending upwardly from the bottom end and a beveled rim defining an upper edge of the mouthpiece sidewall. The mouthpiece is contoured to a shape of a user's open mouth.

These and further objects and features of the invention are apparent in the disclosure, which includes the above and ongoing written specification, with the drawings.

DETAILED DESCRIPTION OF THE PREFERRED EMBODIMENTS

Figure 1:
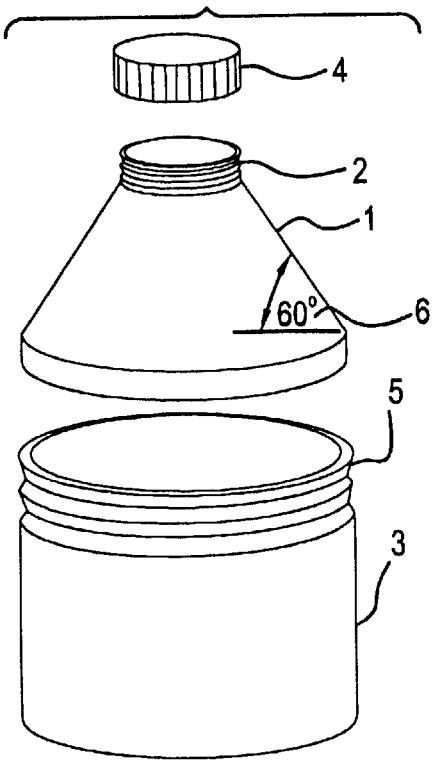
FIG. 1 shows a preferred embodiment of a hand-held container and symmetrically tapered conical spout and protruding mouthpiece whose outer rim is in a plane normal to its axis and with a threaded cap.
Figure 2:
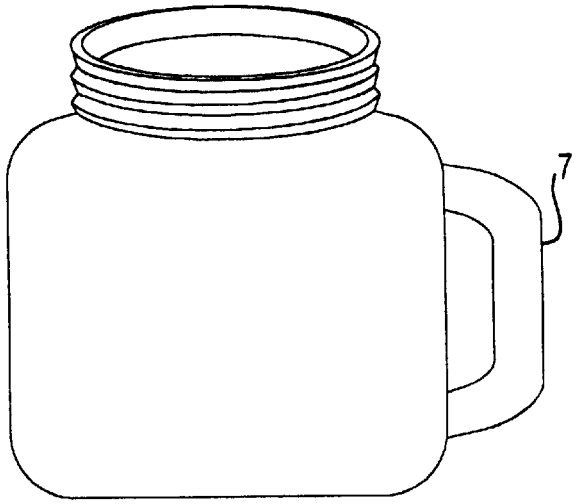
FIG. 2 shows an alternative embodiment of a hand-held container having an attached handle.

FIG. 1 shows a uniformly tapered conical spout 1, preferably molded from a thermoplastic material, which attaches to the opening 5 on a container 3 by a threaded fitting. This attachment could also be a snap-on fitting. This opening has a minimum diameter (if round) or width (if rectangular) of seventy (70) millimeters and a maximum of one hundred and twenty (120) millimeters with eighty-five (85) millimeters the optimum dimension. If the container has a carrying handle 7 shown in FIG. 2, the maximum horizontal axial dimension could be increased to one hundred and sixty (160) millimeters. The spout 1 has a side slope 6 as measured from the horizontal axis of at least thirty (30) degrees and not greater than seventy-five (75) degrees with sixty (60) degrees being optimal. The spout should provide a void space (volume) equal to fifteen (15) percent or more of the volume of the container 3.

Figure 3:
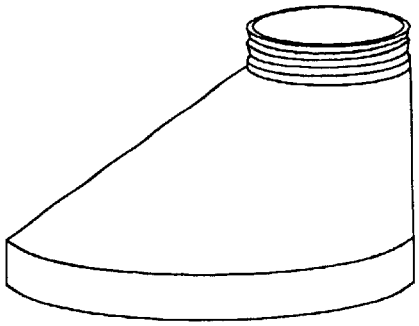
FIG. 3 shows an asymmetrically tapered spout.
Figure 4:
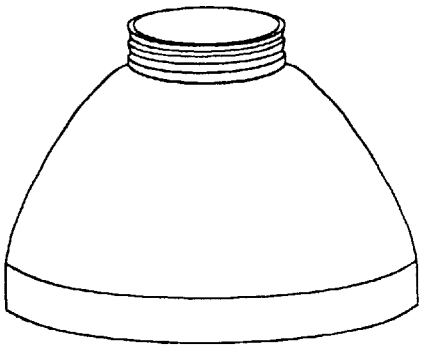
FIG. 4 shows a curved body, dome-type spout.
Figure 5:
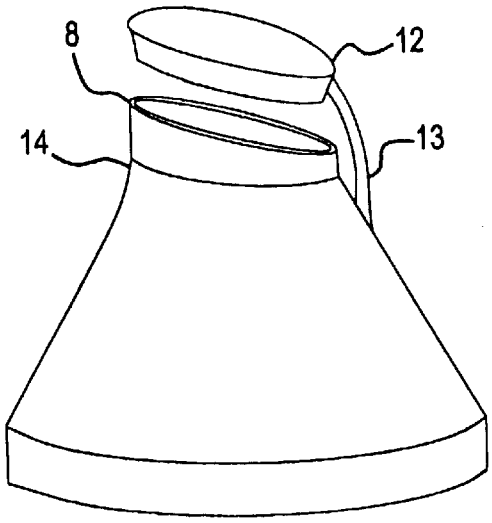
FIG. 5 shows the conical spout of FIG. 1 with a beveled mouthpiece and snap-on closure cap with a flexible connection to the spout.
Figure 8:
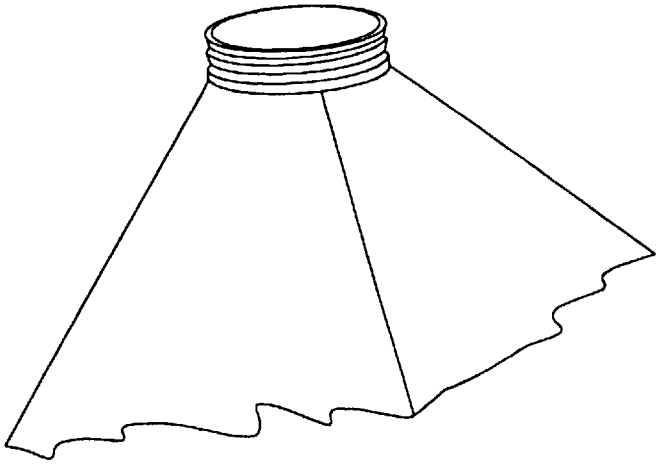
FIG. 8 shows a pyramid-shaped spout.

The spout can take several shapes as shown in the examples in FIGS. 3, 4, 5 and 8. FIG. 3 shows an asymmetrically tapered conical, or funnel-shaped, spout with the outer wall of the mouthpiece in line with the wall of the container when attached. This configuration permits the maximum benefit of the void space in the creation of a free surface condition when the container is full, and the mouthpiece is oriented at the top of the container when tipping. Also, when the container is near empty, it permits easier removal of remaining food if the mouthpiece is rotated so it is at the bottom of the tipped container. FIG. 4 shows a spout with curved side walls, or dome-shaped, rather than conical. The same void space requirement as stated above apply to these shapes. FIG. 8 shows a pyramid shaped spout.

Figure 6:
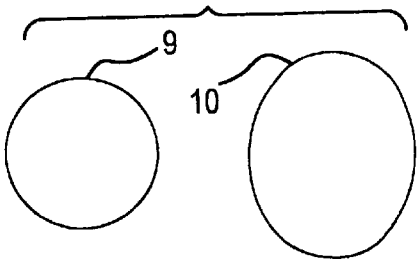
FIG. 6 shows typical mouthpiece cross sections.
Figure 7:
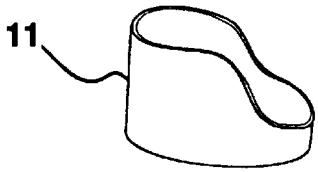
FIG. 7 shows a preferred mouthpiece profile with a contoured entrance to fit the mouth.

The spout terminates on the upper end with the pour opening, or mouthpiece 2. This mouthpiece is tubular and projects somewhat from the walls of the spout, but the joint between the two is always fair and rounded 14. It can have a circular or oval cross section as shown in FIG. 6 but with no axial internal dimension less than twenty-six (26) millimeters, with thirty-six (36) millimeters optimum for 9, and optimum axial values of thirty-three (33) millimeters and thirty-eight (38) millimeters for 10, with no internal obstructions existing in either. The maximum outside dimension should not exceed fifty (50) millimeters. The mouthpiece on the spouts shown in FIGS. 1, 3 and 4 has an entrance rim which is in a plane normal to the axis of the tubular opening. A preferred embodiment shown in FIG. 5 has the entrance 8 beveled at an angle to the axis of from ten (10) degrees to forty-five (45) degrees to reduce the head tilt required to ingest the food. A further improvement shown in FIG. 7 embodies a mouthpiece contoured to the open mouth to provide a trough to better direct the food particles and reduce spillage. The longer section 11 is placed inside the lower lip. The closure cap may either have a threaded fitting 4 for round mouthpiece projections or a snap-on/press-on fitting 12 which is required on an oval or beveled mouthpiece. Furthermore, a tether 13 is helpful to avoid loss of the cap, but this should be flexible enough or designed in a fashion that it does not strike the user's face.

While the invention has been described with reference to specific embodiments, modifications and variations of the invention may be constructed without departing from the scope of the invention.

I claim:

1. A flaked and granular fibrous cereal food product storing and direct mouth dispensing package apparatus comprising a resilient plastic container having an internal volume for holding the cereal food product, having a container wall, a closed bottom and an open top and having a body with an axial dimension and a transverse dimension suitable for holding in one hand, the transverse dimension being sufficiently large for filling the container with the cereal food product from a cereal box through the open top without spillage from the box of the cereal food product, a minimum size of the transverse dimension of the open end of the container being about 70 millimeters, the container wall having a first fastener near the open top, a spout cap having a larger open end and a sidewall extending around the larger open end with a second complementary fastener on the sidewall for connecting to the first fastener on the container wall near the open end of the container after the container is filled with the cereal food product, the spout cap having a smaller outer open end remote from the larger open end, the spout cap having a tapered sloping wall connecting the larger open end and the smaller open end, the sloping wall sloping at about 30° to about 60° with respect to the axial dimension of the container for preventing nose interference with the sloping wall while the container and the spout cap are tipped for directly feeding the cereal food product into a human mouth, the spout cap having an internal volume at least 15% of the container internal volume, for permitting free flow of the cereal food product along a surface of the cereal food product formed within the cap spout and the container when the container and the cap spout are tilted for causing the surface of the cereal food product to exceed an angle of repose, the spout cap having a mouthpiece extending outwardly from the outer open end at an angle to the tapered sloping wall, the mouthpiece having a projection with walls extending generally in axial directions from the smaller open end of the spout cap, the mouthpiece projection having an internal transverse dimension at least about 26 millimeters sufficiently large to permit passage of largest pieces of the cereal food product, and the mouthpiece projection having outer dimensions sufficiently small to be compatible with a human mouth, the projection having a length sufficiently short for avoiding jamming of the cereal food product flowing therethrough, the mouthpiece projection being oval in cross-section normal to the longitudinal axis thereof and being contoured to the opened mouth for preventing spillage of the cereal food product during direct mouth feeding.

2. The apparatus of claim 1 wherein the mouthpiece projection has a longer section for placing inside a human lower lip and providing a trough for directing particles of the cereal food product into an opened mouth, a shorter section for engaging a human upper lip and sides sloping between the longer section and shorter section for engaging human lips.

3. The apparatus of claim 1, further comprising a closure cap removably covering the mouthpiece for closing the mouthpiece.

4. A flaked and granular fibrous cereal food product storing and direct mouth dispensing package apparatus comprising a plastic container having an internal volume for holding the cereal food product, having a container wall, a closed bottom and an open top and having a body with an axial dimension and a transverse dimension suitable for holding in one hand, the transverse dimension being sufficiently large for filling the container with the cereal food product from a cereal box through the open top without spillage from the box of the cereal food product, the container wall having a first fastener near the open top, a spout cap having a larger open end and a smaller open end, a sidewall extending around the larger open end with a second complementary fastener on the sidewall for connecting to the first fastener on the container wall near the open end of the container after the container is filled with the cereal food product, the spout cap having the smaller outer open end remote from the larger open end, the spout cap having a tapered sloping wall connecting the larger open end and the smaller open end, for holding the cereal food product along the sloping wall while the container and the spout cap are tipped for directly feeding the cereal food product into a human mouth, the spout cap having an internal volume at least 15% of the container internal volume, for permitting free flow of the cereal food product along a surface of the cereal food product formed within the cap spout and the container when the container and cap spout are tilted for causing the surface of the cereal food product to exceed an angle of repose, the spout cap having a mouthpiece projection extending outwardly from the outer open end at an angle to the tapered sloping wall, the mouthpiece projection having walls extending generally in an axial direction with respect to the container and the spout cap, the mouthpiece projection having an internal transverse dimension sufficiently large to permit passage of largest pieces of the cereal food product and the mouthpiece projection having outer dimensions sufficiently small to be compatible with a human mouth, the projection having a length sufficiently short for avoiding jamming of the cereal food product flowing therethrough, the mouthpiece projection being oval in cross-section normal to the longitudinal axis thereof and being contoured to the open mouth for preventing spillage of the cereal food product during direct mouth feeding.

5. The apparatus of claim 4, wherein the tapered sloping wall forms a non-uniformly tapered cone with an angle of rise from horizontal between about thirty degrees and about seventy-five degrees; and wherein the walls of the mouthpiece projection form side lips and a bottom lip, wherein the side lips are disposed at angles to the bottom lip of between about ten degrees to about forty-five degrees.

6. The apparatus of claim 5 wherein the mouthpiece has an internal cross-sectional dimension of between about twenty-six millimeters and about fifty millimeters.

7. The apparatus of claim 5, wherein the container body has a cross-section not exceeding about one hundred and twenty millimeters for permitting the user to grip the container in one hand.

8. The apparatus of claim 5 further comprising a handle extending from the sidewalls of the container body.

9. The apparatus of claim 4, further comprising a releasable closure connected to the mouthpiece and a flexible tether connected to the closure and to the cap.

10. The apparatus of claim 4, wherein the tapered sloping wall describes a non-uniformly tapered cone, or pyramid, such that the mouthpiece is situated off a central vertical axis of the open end of the container body and the rim of the cap.

11. The apparatus of claim 4, wherein a cross-section of the smaller open end is curved, and a plane of an outer rim of the smaller open end is perpendicular to a central axis of the larger open end.

12. The apparatus of claim 11 wherein a plane of an outer rim of the mouthpiece is beveled at an angle to the central axis of between about ten degrees and about forty-five degrees.

13. The apparatus of claim 11 wherein the smaller open end has a circular or oval cross-section.

14. The apparatus of claim 11 wherein the sloping wall is dome-shaped.

15. The apparatus of claim 11 wherein the sloping wall is conical.

16. The apparatus of claim 11 wherein the sloping wall is pyramid-shaped.

17. The apparatus of claim 11 wherein the first fastener is threaded-type and wherein the second fastener is threaded-type.

18. The apparatus of claim 11 wherein the first fastener is snap-on or press-fit type and wherein the second fastener is snap-on or press-fit type.

19. The apparatus of claim 4, wherein the sloping wall is a tapered cone with an angle of rise from a horizontal axis between about thirty degrees and about seventy-five degrees wherein a cross-section of the smaller open end is curved, and a plane of an outer rim of the smaller open end is parallel to a central axis of the larger open end; and wherein the sloping wall is a non-uniformly tapered cone such that the smaller open end is situated off a central vertical axis of the larger open end, such that an outermost wall of the smaller open end aligns with a wall of the larger open end and with a wall of the container.

20. The apparatus of claim 4, wherein the spout cap is a substantially hollow frustoconical-shaped spout wherein the tapered sloping wall has an angle of rise from horizontal between about thirty degrees and about seventy-five degrees;

wherein the mouthpiece projection is a substantially hollow mouthpiece integrally formed with and extending upwardly from said sidewall of said spout and circumscribing said smaller open end; and wherein the tapered sloping wall is non-uniformly tapered and wherein a top part of said mouthpiece is cut off by a plane that is not parallel to said base thereby forming an opening.

21. The apparatus of claim 4, wherein the mouthpiece projection includes a longer section for placing inside a human lower lip and providing a trough for directing particles of the cereal food product into an opened mouth, a shorter section for engaging a human upper lip and sides sloping between the longer section and shorter section for engaging human lips.

22. The apparatus of claim 4, further comprising a closure cap removably positioned by the mouthpiece for covering and for closing the mouthpiece.

23. A method of storing and direct mouth dispensing of a flaked and granular fibrous cereal food product, comprising filling an internal volume of a plastic food container with a cereal food product by pouring the cereal food product from a cereal box through an open top of the container, storing the cereal food product in the container, connecting a larger open end of the spout cap to the open top of the container, providing in the spout cap a void having an internal volume of at least about 15% of the internal volume of the container, providing a smaller open end of the spout cap remote from the larger open end and connecting the larger open end and the smaller open end with a tapered sloping wall, extending a mouthpiece projection from the smaller open end at an angle to the sloping tapered wall and in a direction generally parallel to an axial direction of the container and spout cap, holding the container with one hand and placing a longer section of the mouthpiece projection inside a human lower lip, tipping the container and the spout cap and engaging a human upper lip with a shorter section of the mouthpiece projection and engaging sloping sides of the mouthpiece projection between the longer section and the shorter section with the human lips, flowing the cereal food product into the spout cap and forming a surface of the cereal food product in the spout cap and in the container, tipping the spout cap and the container beyond an angle of repose of the surface and freely flowing the cereal food product along the surface and into and through the mouthpiece projection into a human mouth, tipping the container and spout cap downward and stopping the free flow of the cereal food product along the surface through the mouthpiece projection and into a human mouth and capping the mouthpiece projection.

* * * * *